US005510821A

United States Patent [19]

Jones et al.

[11] Patent Number: 5,510,821

[45] Date of Patent: Apr. 23, 1996

[54] SOLID INK STICK

[75] Inventors: Brent R. Jones, Tualatin; Clark W. Crawford, Wilsonville, both of Oreg.

[73] Assignee: Tektronix, Inc., Wilsonville, Oreg.

[21] Appl. No.: 309,364

[22] Filed: Sep. 20, 1994

[51] Int. Cl.[6] ..... B41J 2/175

[52] U.S. Cl. ..... 347/88; D18/56

[58] Field of Search ..... 347/88, 99; D18/56; 106/23 A, 22 A

[56] References Cited

U.S. PATENT DOCUMENTS

| | | | |
|---|---|---|---|
| D. 275,965 | 10/1984 | Bellini | D18/56 |
| D. 335,683 | 5/1993 | Smith | D18/56 |
| D. 346,821 | 5/1994 | Smith | D18/56 |
| 4,490,731 | 12/1984 | Vaught | 347/88 X |
| 4,593,292 | 6/1986 | Lewis | 347/88 X |
| 4,609,924 | 9/1986 | DeYoung | 347/88 |
| 4,682,185 | 7/1987 | Martner | 347/88 |
| 4,682,187 | 7/1987 | Martner | 347/88 |
| 4,739,339 | 4/1988 | DeYoung et al. | 347/88 |
| 4,814,786 | 3/1989 | Hoisington et al. | 347/88 |
| 4,864,330 | 9/1989 | Creagh et al. | 347/88 |
| 4,870,430 | 9/1989 | Daggett et al. | 347/88 |
| 5,038,157 | 8/1991 | Howard | 347/88 |
| 5,223,860 | 6/1993 | Loofbourow et al. | 347/88 |
| 5,276,468 | 1/1994 | Deur et al. | 347/88 |

*Primary Examiner*—Joseph W. Hartary
*Attorney, Agent, or Firm*—Ralph D'Alessandro

[57] ABSTRACT

An ink stick shape for use in a printer ink stick feed chute is disclosed wherein the opposing sides of the ink stick are tapered or angled from the horizontal so that at least one area intermediate the top and the bottom of the ink stick is a greater distance from the horizontal than the junction of the side walls and the bottom of the ink stick. The ink stick shape or geometry may be keyed to a particular color.

12 Claims, 2 Drawing Sheets

SOLID INK STICK

FIELD OF THE INVENTION

This invention relates generally to color printer inks and, more specifically, to the particular shape of the solid phase change ink sticks used in the ink feed chutes of a phase change ink color printer. The particular ink shape minimizes the sticking of the solid ink sticks to the sides of the feed chutes as they are fed down the feed chutes to the reservoir area where they are melted and stored in liquid form for ejection by the print head onto a receiving medium.

BACKGROUND OF THE INVENTION

Solid ink jet printers were first offered commercially in the mid-1980's. One of the first such printers was offered by Howtek Inc. and used pellets of colored cyan, yellow, magenta and black ink that were fed into shape coded openings that fed generally vertically into the heater assembly of the printer where they were melted into a liquid state for jetting onto the receiving medium. The pellets were fed generally vertically downwardly, using gravity feed, into the printer. These pellets were elongated and tapered on their ends with separate rounded, five, six, and seven sided shapes each corresponding to a particular color.

Later more successful solid ink printers, such as the Tektronix Phaser™ III and the Jolt printer offered by Dataproducts Corporation, used differently shaped solid ink sticks that were either gravity fed or spring loaded into a feed chute and pressed against a heater plate to melt the solid ink into its liquid form. These ink sticks were shape coded and of a generally small size. As phase change ink color printers increase their printing speed there is the need to provide larger sized ink sticks so that refill of the ink reservoir in the print head is less frequent and more output or prints can be produced between refills. In designs where there is not a steep or generally vertical feed path to the heater plate, some provisions must be made to prevent the solid masses of shaped ink from sticking to the sides of the feed chutes so that an unrestricted feed of ink sticks proceed down into the heater plate for melting and filling the individual colored ink reservoirs that are usually located within the print head. Larger sized ink sticks especially have the tendency to hang up or catch within the feed chutes when there is not a steep feed path, especially because of the sticky nature of the ink sticks' waxy exterior surfaces.

This problem is solved in the design of the ink stick masses of the present invention by the use of a drafted or tapered design that presents only a small surface area for the ink stick to contact the adjacent wall of the feed chute. The opposing sides of the ink sticks extend between the top and the bottom surfaces at an angle.

SUMMARY OF THE INVENTION

It is an object of the present invention to provide a solid ink stick shape that presents a minimum surface area for contact with the sides of the solid stick ink feed chute.

It is another object of the present invention to provide a solid ink stick shape that does not tend to catch or become obstructed within the solid ink stick feed chute.

It is a feature of the present invention that the solid ink sticks of the present invention are drafted or tapered from top to bottom.

It is another feature of the present invention that the solid ink sticks of the present invention have a semi-protruding nose in the center of each end to prevent or minimize jamming due to wedging along the sides of the feed chute.

It is still another feature of the present invention that the individual ink sticks have melt fronts which contact the heater or melting plates of the print head which vary as the ink is melted and have front to rear angles that change the cross-sectional area in contact with the melting plate very slowly.

It is yet another feature of the present invention that the angles and depth of the keying features, as well as the draft angles, of the solid ink sticks of the present design have been developed so that cracking and uneven cooling during manufacture are minimized.

It is a further feature of the present invention that the solid ink sticks are symmetrical in top to bottom configuration so that either the top surface or the bottom surface may be inserted facing the bottom surface of the feed chute.

It is an advantage of the present invention that slivers or wings of unmelted ink do not form at the sides of the ink sticks to clog or interfere with the feed of the solid ink sticks down the feed chutes to the melting plates.

It is another advantage of the present invention that a reliable straight line feed of the solid ink sticks down the feed chute is obtained.

It is still another advantage of the present invention that the top to bottom draft or tapering of the ink sticks is sufficient to present only a small contact line with the adjacent side walls of the feed chute.

It is yet another advantage of the present invention that the basic shape of the solid ink sticks utilize radii and minimal abrupt corners about the entire ink stick to minimize the opportunity for chipping.

These and other objects, features and advantages are obtained by the use of a solid ink stick design that utilizes a tapered or drafted design on the opposing sides from the top surface to the bottom surface such that the solid ink sticks move down the feed chute in the printer to the melting plate without chipping or becoming caught against the side walls of the feed chute.

BRIEF DESCRIPTION OF THE DRAWINGS

These and other objects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
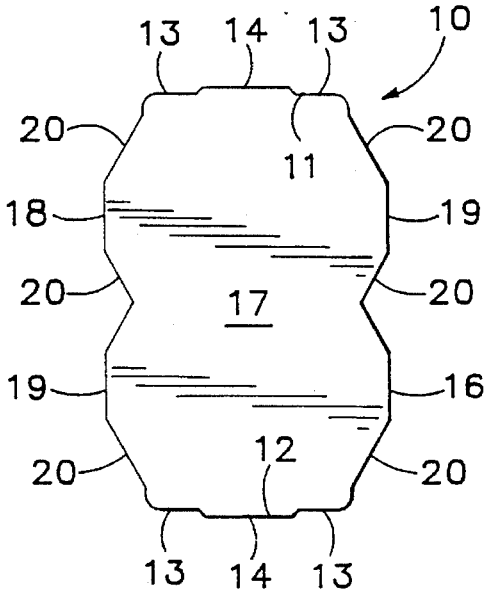
FIG. 1 is a top plan view of an ink stick that is illustrative of the design of the present invention.

FIG. 1 shows a top plan view of a representative solid ink stick shape configuration indicated generally by the numeral 10. Ink stick 10 has a front end 11 and opposing rear end 12, each having a semi-protruding nose portion 14 with adjacent recessed end portions 13. Ink stick 10 has an illustrative design with angled side portions 20 that taper toward front to rear on the center line of the ink stick from the opposing first side 16 and opposing second side 18. Flat side portions 19 are bracketed by the angled side portions 20. Angled side portions 20 can be of any particular configuration and it is understood that in a broader concept of the invention, any suitable geometric shape may be employed which utilizes the features of the invention of having tapered or drafted sides. Flat side portions 19 comprise less than about 50% of the overall length of the ink stick 10. Ink stick 10 has a generally planar top surface 17' and a corresponding bottom surface 17, indicated in FIGS. 2 and 3.

Figure 2:
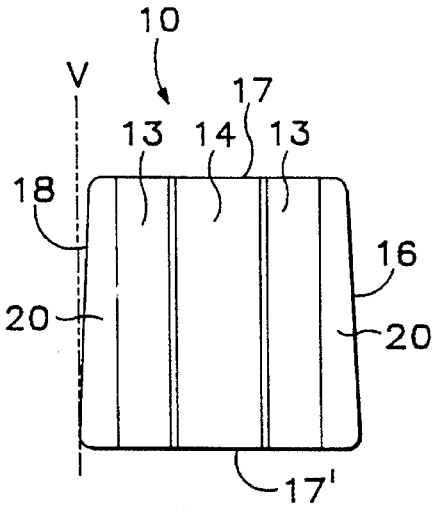
FIG. 2 is an end elevational view of an ink stick that is illustrative of the design of the present invention showing a semi-protruding nose in the center of the end along the entire height of the ink stick.
Figure 2A:
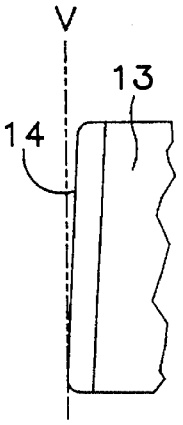
FIG. 2*a* is a partial end elevational view of an ink stick that is illustrative of the design of the present invention with the center portion of the ink stick broken away.
Figure 3:
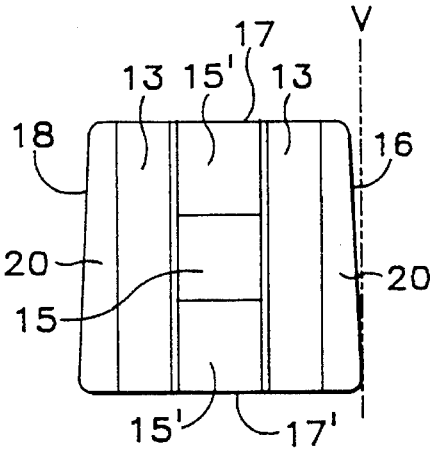
FIG. 3 is an end elevational view of one end of an ink stick that is illustrative of the design of the present invention showing an alternative semi-protruding nose in the center of one end of the ink stick.

FIGS. 2 and 3 show two possible approaches to the use of the semi-protruding nose portion 14, where in FIG. 2 the nose portion 14 extends the entire height between the top 17' and the bottom 17. In FIG. 3, the semi-protruding nose portion is only located in the central portion 15 while the over and under lying regions 15' are recessed.

Figure 4:
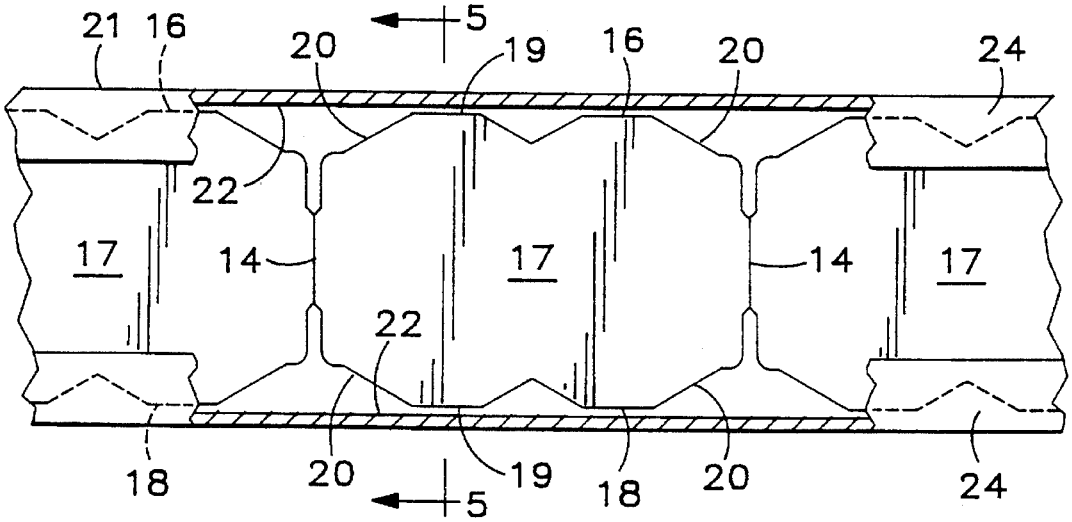
FIG. 4 is a top plan view of a plurality of solid ink sticks aligned end to end in a feed chute in a color printer showing the side walls of the feed chute and the opposing sides of the ink sticks.

FIG. 4 shows the end to end alignment of ink sticks 10 within the printer feed chute 21. Chute 21 has opposing side walls with inner side surfaces 22 against which a small portion of the ink sticks 10 contact on their opposing sides 16 and 18. Feed chute 21 can have overhanging lips 24 that cover a portion of the chute or feed channel and prevent removal of the ink sticks 10 along the length of the chute. Covering lip 24 can have the distinctive shape or pattern of the particular color ink stick 10 in the lips to permit only the appropriate color to be fed from the top into the chute 21. Ink sticks 10 can be inserted within chute 21 with either surface 17 or 17' being up so the taper is from the top or the bottom because of the symmetrical design of the ink sticks. Only one color ink stick 10 fits into its corresponding feed chute 21 so that there are generally four feed chutes 21 aligned side by side to feed cyan, yellow, magenta and black distinctively shaped ink sticks to a heater plate where the ink is melted and flows into a reservoir within the print head (not shown) for jetting from a pressure chamber onto the receiving medium to create a print image. A representative print head appropriate for use with ink sticks of the composition of the present invention is shown in U.S. Pat. No. 5,087,930 issued Feb. 11, 1992 to Roy et al. and assigned to the assignee of the present invention.

Figure 5:
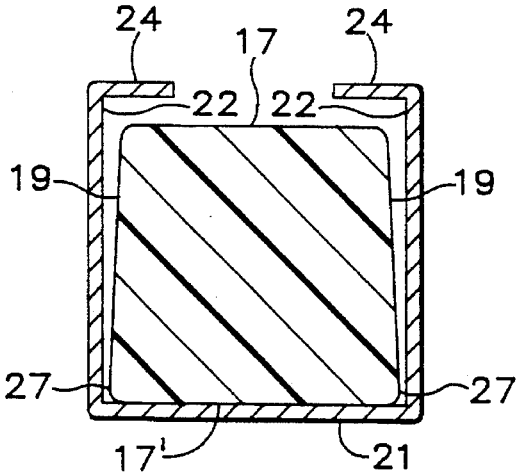
FIG. 5 is a sectional view taken along the lines 5—5 of FIG. 4 showing a limited line of contact of the opposing sides of the solid ink sticks with the adjacent sides of the feed chute because of the drafting or tapered angles of the opposing sides of the solid ink sticks.
Figure 6:
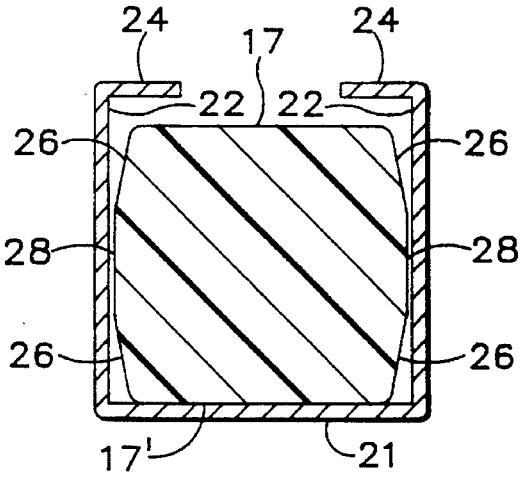
FIG. 6 is a sectional view taken along the same lines 5—5 of FIG. 4 showing an alternative embodiment of a solid ink stick having a center contact line or stripe extending along the opposing sides of the ink stick.

FIGS. 5 and 6 show two potential embodiments for feeding ink sticks 10 through the chute 21 by viewing them along the section lines 5—5 of FIG. 4. FIGS. 2 and 5 show the slight drafting or tapering from the vertical of the opposing sides 16 and 18 of the ink sticks 10 between the bottom and top surfaces 17 and 17'. The angle from the vertical V (see FIGS. 2, **2*a* & 3) can be a slight one from about ½ degree to about 10 degrees, more preferably from about 3 to about 7 degrees, and most preferably about 5 degrees from top to bottom so only a narrow contact line or area of contact is employed to minimize clogging or drag or surface friction against the inner side walls 22 of the feed chute 21. In FIG. 5 the contact area 27 is shown adjacent the bottom of chute 21. Preferably, the ink sticks 10 do not contact the inner side walls 22 of the feed chute 21 at all. This design provides an area of the opposing sides 16 and 18 adjacent the top surface 17 that is a greater distance from the vertical V taken through the point where the bottom surface 17', for example, intersects or junctions with the opposing sides 16 and 18. Regardless of the particular geometric shape utilized, the percentage of length of the sides of the ink stick 10 available as a flat portion to serve as a contact line or contact area with the inner side walls 22 of feed chute 21 is less than about 50%** of the overall length of the ink stick.

An alternative embodiment is shown in FIG. 6 where there is a central band or contact area 28 on each opposing side of the ink stick 10. Above and below the central contact area 28 is a tapered side 26 that is angled away from the opposing inner side walls 22 of the chute 21 to minimize the contact area 28 of the ink stick 10 with the inner side walls of 22 of the feed chute 21. This design provides an area of the opposing sides 16 and 18 intermediate the top and bottom surfaces 17 and 17' that is a greater distance from the vertical V taken through the point where the top surface 17, for example, intersects or junctions with the opposing sides 16 and 18.

Inner side walls 22 can be straight as shown in FIG. 5 or angled from the vertical as you move from the bottom to the top of the chute. Where the inner side walls 22 of chute 21 are angled the taper on the ink sticks 10 must be such that the angle of the ink stick 10 sidewalls must be greater than the angle on the chute 21 sidewalls. Although the ink sticks 10 can be inserted within the feed chute 21 with either surface 17 or 17' up, it is preferable that the taper on the inks sticks 10 be such that the areas with the greater distance from the horizontal are adjacent the bottom narrowed end of chute 21.

It should be noted that the solid phase change ink employed in the ink sticks 10 of the instant invention can be any appropriate phase change ink that employs a suitable colorant, such as dye, and an ink carrier composition which is compatible with the colorant. Such a suitable composition is described in U.S. patent application Ser. No. 07/981,677 filed Nov. 25, 1992, now U.S. Pat. No. 5,372,852, and in U.S. Pat. No. 4,889,560 issued Dec. 26, 1989, both assigned to the Assignee of the present invention, which are herein specifically incorporated by reference in pertinent part. The phase change ink of this composition employs a carrier composition that utilizes a fatty-amide containing material which may be any appropriate amide compound, such as typically a tetra-amide, and/or a triamide compound and/or a mono-amide compound or other suitable amides, and combinations thereof. As described in the above referenced U.S. Patent, the appropriate colorant can be employed to achieve cyan, magenta, yellow and black colors suitable for ink jet color printing applications.

While the invention has been described above with reference to specific embodiments thereof, it is apparent that many changes, modifications and variations in the materials, arrangements of parts and steps can be made without departing from the inventive concept disclosed herein. For example, in employing the solid ink stick configuration or shape of the present invention, it should be noted that the ink sticks 10 can be formed by any suitable process such as molding, extruding, or pouring into a container for shipping in which the ink cools and solidifies. The opposing top and bottom planar surfaces 17 and 17' can be of any shape, such as rounded or pointed, as well as the preferred generally planar shown to minimize friction with the bottom of fed chute 21. The bottom of chute 21 can have an appropriate material, such as a fiber with a nylon/Teflon® weave, attached to its inner surface in strips or across the entire bottom to minimize friction. The material should have a static coefficient of friction of less than about 1.3 at about 50° C. for both the temperature of the ink sticks 10 and the fiber material.

Accordingly, the spirit and broad scope of the appended claims is intended to embrace all such changes, modifications and variations that may occur to one of skill i the art upon a reading of the disclosure. All patent applications, patents and other publications cited herein are incorporated by reference in their entirety.

Having thus described the invention, what is claimed is:

1. An ink stick for use in a printer having, in combination:

(a) a top surface and an opposing bottom surface; and (b) a first side and an opposing second side connecting the top surface and the opposing bottom surface at junctions, the first side and opposing second side being at least partly angled from a vertical line through at least one of the junctions such that one area intermediate the top surface and the bottom surface is a greater distance from the vertical line than at least one of the junctions.

2. The ink stick according to claim 1 further including a front surface and an opposing rear surface connecting the top surface and the bottom surface, each one of the front surface and opposing rear surfaces having a protruding area for contacting adjacent ink sticks when aligned end to end.

3. The ink stick according to claim 2 wherein the protruding area is angled from the vertical.

4. The ink stick according to claim 2 wherein the protruding area extends between the top surface and the opposing bottom surface.

5. The ink stick according to claim 2 wherein the protruding area extends less than between the top surface and the opposing bottom surface.

6. The ink stick according to claim 5 wherein the protruding area is central between the top surface and the opposing bottom surface.

7. The ink stick according to claim 1 wherein the one area intermediate the top surface and the opposing bottom surface is central there between.

8. The ink stick according to claim 1 wherein the one area intermediate the top surface and the opposing bottom surface is adjacent the bottom surface.

9. The ink stick according to claim 1 wherein the one area intermediate the top surface and the opposing bottom surface is adjacent the top surface.

10. The ink stick according to claim 1 wherein the ink stick has a length defined between a front surface and an opposing rear surface, the first side and opposing second side further having at least one flat portion each such that the flat portion on each of the first side and the opposing second side comprises less than about 50% of the length of the ink stick.

11. An ink stick feed chute and ink stick design comprising in combination, (a) an ink stick feed chute bottom connected to opposing chute side walls and a partially open top covering;

(b) an ink stick top surface and an opposing bottom surface; and (c) an ink stick first side and an opposing second side connecting the ink stick top surface and the ink stick opposing bottom surface at junctions, the ink stick first side and the ink stick opposing second side being at least partly angled from a vertical line through at least one of the junctions such that one area intermediate the top surface and the bottom surface is a greater distance from the vertical line than at least one of the junctions to minimize contact of the ink stick first side and ink stick opposing second side with the chute opposing side walls.

12. The ink stick feed chute and ink stick design according to claim 11 where in the ink stick feed chute top covering opening is keyed to a distinctive shape of the ink stick to permit only an appropriately shaped ink stick to be fed thereinto.

* * * * *

US005510821B1

REEXAMINATION CERTIFICATE (4073rd)

United States Patent [19] [11] B1 5,510,821

Jones et al. [45] Certificate Issued May 2, 2000

[54] SOLID INK STICK

[75] Inventors: Brent R. Jones, Tualatin; Clark W. Crawford, Wilsonville, both of Oreg.

[73] Assignee: Tektronix, Inc., Wilsonville, Oreg.

Reexamination Request:
No. 90/004,948, Mar. 26, 1998

Reexamination Certificate for:

| | |
|---|---|
| Patent No.: | **5,510,821** |
| Issued: | **Apr. 23, 1996** |
| Appl. No.: | **08/309,364** |
| Filed: | **Sep. 20, 1994** |

[51] Int. Cl.[7] ..... B41J 2/175
[52] U.S. Cl. ..... 347/88; D18/56
[58] Field of Search ..... 347/88, 99

[56] References Cited

U.S. PATENT DOCUMENTS

| | | | |
|---|---|---|---|
| D. 275,965 | 10/1984 | Bellini | D18/56 |
| D. 310,130 | 8/1990 | van Kooten | D1/100 |
| D. 335,683 | 5/1993 | Smith | D18/56 |
| D. 346,821 | 5/1994 | Smith | D18/56 |
| 4,490,731 | 12/1984 | Vaught | 347/88 |
| 4,593,292 | 6/1986 | Lewis | 347/88 |
| 4,609,924 | 9/1986 | De Young | 347/88 |
| 4,636,803 | 1/1987 | Mikalsen | 347/88 |
| 4,682,185 | 7/1987 | Martner | 347/88 |
| 4,682,187 | 7/1987 | Martner | 347/88 |
| 4,739,339 | 4/1988 | DeYoung et al. | 347/88 X |
| 4,814,786 | 3/1989 | Hoisington et al. | 347/88 |
| 4,823,146 | 4/1989 | Cooke et al. | 347/88 X |
| 4,864,330 | 9/1989 | Creagh | 347/88 |
| 4,870,430 | 9/1989 | Daggett et al. | 347/88 |
| 5,003,322 | 3/1991 | Creagh et al. | 347/88 |
| 5,038,157 | 8/1991 | Howard | 347/88 |
| 5,123,961 | 6/1992 | Yamamoto | 106/31 |
| 5,124,719 | 6/1992 | Matsuzaki | 347/88 |
| 5,170,187 | 12/1992 | Oikawa | 347/88 X |
| 5,223,860 | 6/1993 | Loofbourow et al. | 347/88 |
| 5,259,873 | 11/1993 | Fujioka | 347/99 X |
| 5,270,730 | 12/1993 | Yaegashi et al. | 347/88 X |
| 5,276,468 | 1/1994 | Deur et al. | 347/88 X |
| 5,341,164 | 8/1994 | Miyazawa et al. | 347/88 |
| 5,405,438 | 4/1995 | Fujioka | 347/99 X |

FOREIGN PATENT DOCUMENTS

| | | | |
|---|---|---|---|
| 6143558 | 5/1994 | Japan | B41J 2/015 |

OTHER PUBLICATIONS

Tektronix Supplies and Accessories Catalog, Jan. 1993, pp. 4–5 plus photographs and measurement sheet.

*Primary Examiner*—Joseph Hartary

[57] ABSTRACT

An ink stick shape for use in a printer ink stick feed chute is disclosed wherein the opposing sides of the ink stick are tapered or angled from the horizontal so that at least one area intermediate the top and the bottom of the ink stick is a greater distance from the horizontal than the junction of the side walls and the bottom of the ink stick. The ink stick shape or geometry may be keyed to a particular color.

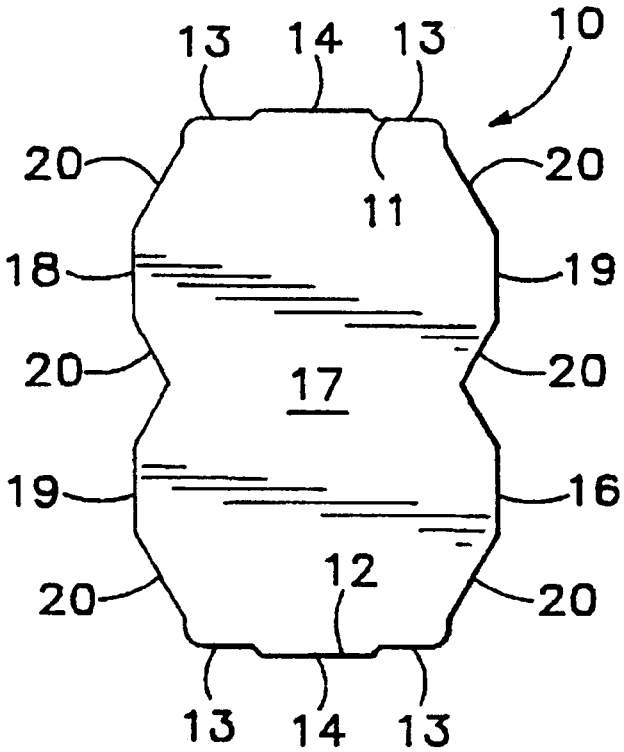

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 10 are cancelled.

Claims 1, 3–5, 7–9 and 11 are determined to be patentable as amended.

Claims 6 and 12, dependent on an amended claim, are determined to be patentable.

New claims 13–20 are added and determined to be patentable.

1. An ink stick for use in a printer having, in combination:

(a) a top surface and an opposing bottom surface; [and]

(b) *a front surface and an opposing rear surface connecting the top surface and the bottom surface, each one of the front surface and opposing rear surface having a protruding area intermediate the top surface and the bottom surface for contacting adjacent ink sticks when aligned end to end; and*

(*c*) a first side and an opposing second side connecting the top surface and the opposing bottom surface at junctions, *the top surface being generally planar and extending uninterrupted between the first side and the opposing second side,* the first side and opposing second side *further* being at least partly angled from a vertical line through at least one of the junctions such that one area intermediate the top surface and the bottom surface is a greater distance from the vertical line than at least one of the junctions.

3. The ink stick according to claim [2] *1* wherein the protruding area is angled from the vertical.

4. The ink stick according to claim [2] *1* wherein the protruding area extends between the top surface and the opposing bottom surface.

5. The ink stick according to claim [2] *1* wherein the protruding area extends less than between the top surface and the opposing bottom surface.

7. The inks stick according to claim 1 wherein the [one] *protruding* area intermediate the top surface and the opposing bottom surface is central there between.

8. The ink stick according to claim 1 wherein the [one] *protruding* area intermediate the top surface and the opposing bottom surface is adjacent the bottom surface.

9. The ink stick according to claim 1 wherein the [one] *protruding* area intermediate the top surface and the opposing bottom surface is adjacent the bottom surface.

11. An ink stick feed chute and ink stick design comprising in combination, (a) an ink stick feed chute bottom connected to opposing chute side walls and a partially open top covering;

(b) an ink stick top surface and an opposing bottom surface; [and]

(c) *a front surface and an opposing rear surface connecting the top surface and the bottom surface, each one of the front surface and opposing rear surface having a protruding area intermediate the front surface and the opposing rear surface for contacting adjacent ink sticks when aligned end to end; and*

(*d*) an ink stick first side and an opposing second side connecting the ink stick top surface and the opposing bottom surface at junctions, *the ink stick top surface being generally planar and extending uninterrupted between the ink stick first side and the opposing second side,* the *ink stick* first side and the *ink stick* opposing second side *further* being at least partly angled from a vertical line through at least one of the junctions such that one area intermediate the top surface and the bottom surface is a greater distance from the vertical line than at least one of the junctions to minimize contact of the ink stick first side and ink stick opposing second side with the chute opposing side walls.

*13. The ink stick according to claim 1 wherein the angle from the vertical is from about ½ degree to about 10 degrees.*

*14. The ink stick according to claim 1 wherein the angle from the vertical is from about 3 degrees to about 7 degrees.*

*15. The ink stick according to claim 1 wherein the angle from the vertical is about 5 degrees.*

*16. The ink stick according to claim 11 wherein the protruding area is angled from the vertical.*

*17. The ink stick according to claim 11 wherein the protruding area is central between the top surface and the opposing bottom surface.*

*18. An ink stick for use in a printer having, in combination:*

(*a*) *a top surface and an opposing bottom surface; and*

(*b*) *a front surface and an opposing rear surface defining a length of the ink stick by the distance therebetween; and*

(*c*) *a first side and an opposing second side connecting the top surface and the opposing bottom surface at junctions, the top surface being generally planar and extending uninterrupted between the first side and the opposing second side, the first side and the opposing second side having at least one flat portion each such that the flat portion on each of the first side and the opposing second side comprises less than about 50% of the length of the ink stick, the top surface further extending between the first side and the opposing second side, the first side and opposing second side further being at least partly angled from a vertical line through at least one of the junctions such that one area intermediate the top surface and the bottom surface is a greater distance from the vertical line than at least one of the junctions.*

*19. An ink stick feed chute and ink stick design comprising in combination,*

(*a*) *an ink stick feed chute bottom connected to opposing chute side walls and a partially open top covering;*

(*b*) *an ink stick top surface and an opposing bottom surface;*

(*c*) *a front surface and an opposing rear surface defining a length of the ink stick by the distance therebetween; and*

(*d*) *an ink stick first side and an ink stick opposing second side connecting the ink stick top surface and the opposing bottom surface at junctions, the ink stick top surface being generally planar and extending uninterrupted between the ink stick first side and the ink stick*

*opposing second side, the ink stick top surface extending between the ink stick first side and the opposing second side, the ink stick first side and the ink stick opposing second side having at least one flat portion each such that the flat portion on each of the first side and the opposing second side comprises less than about 50% of the length of the ink stick, the ink stick first side and the ink stick opposing second side further being at least partly angled from a vertical line through at least one of the junctions such that one area intermediate the top surface and the bottom surface is a greater distance from the vertical line than at least one of the junctions to minimize contact of the ink stick first side and ink stick opposing second side with the chute opposing side walls.*

*20. The ink stick feed chute and ink stick design according to claim 19 where in the ink stick feed chute top covering opening is keyed to a distinctive shape of the ink stick to permit only an appropriately shaped ink stick to be fed thereinto.*

* * * * *